US008863482B2

(12) United States Patent
Diaz

(10) Patent No.: US 8,863,482 B2
(45) Date of Patent: Oct. 21, 2014

(54) ADJUSTABLE SADDLE

(76) Inventor: Pedro Ruiz Diaz, Buenos Aires (AR)

( * ) Notice: Subject to any disclaimer, the term of this patent is extended or adjusted under 35 U.S.C. 154(b) by 278 days.

(21) Appl. No.: 13/267,481

(22) Filed: Oct. 6, 2011

(65) Prior Publication Data

US 2012/0137640 A1 Jun. 7, 2012

Related U.S. Application Data

(63) Continuation-in-part of application No. 11/674,797, filed on Feb. 14, 2007.

(30) Foreign Application Priority Data

Oct. 11, 2006 (AR) ..... P060104462
Jan. 16, 2007 (AR) ..... P070100178

(51) Int. Cl.
*B68C 1/04* (2006.01)
*B68C 1/02* (2006.01)

(52) U.S. Cl.
CPC ..... *B68C 1/025* (2013.01); *B68C 2001/044* (2013.01); *B68C 1/04* (2013.01)
USPC ..... 54/44.3

(58) Field of Classification Search
USPC ..... 54/44.3, 44.1, 44.7
See application file for complete search history.

(56) References Cited

U.S. PATENT DOCUMENTS

| | | | | | |
|---|---|---|---|---|---|
| 2,667 | A * | 6/1842 | Freed | 54/44.1 |
| 63,322 | A * | 3/1867 | Spurgin | 54/44.4 |
| 786,502 | A * | 4/1905 | Lappan | 54/44.7 |
| 2,034,474 | A * | 3/1936 | Knetsch | 54/44.7 |
| 4,996,827 | A * | 3/1991 | Pellew | 54/44.3 |
| 5,517,808 | A * | 5/1996 | Schleese | 54/44.6 |
| 2005/0011167 | A1* | 1/2005 | Belton | 54/44.1 |
| 2005/0120683 | A1* | 6/2005 | Swain | 54/44.1 |

FOREIGN PATENT DOCUMENTS

EP 744376 A1 * 11/1996 ..... B68C 1/02

* cited by examiner

*Primary Examiner* — Son T Nguyen
(74) *Attorney, Agent, or Firm* — Norris McLaughlin & Marcus PA

(57) ABSTRACT

An adjustable equestrian saddle and adjusting and reinforcing system for adjusting an equestrian saddle to permit the saddle fit several sizes of the back and withers of one or more horses, wherein the adjusting system comprises a plurality of reinforcing members having different angular dimensions with the saddle having a headplate for interchangeably receiving the reinforcing members and a lid to have access to the reinforcing members.

14 Claims, 6 Drawing Sheets

ADJUSTABLE SADDLE

CROSS-REFERENCE TO RELATED APPLICATIONS

This application is a Continuation-in-Part and claims the benefit of U.S. patent application Ser. No. 11/674,797, filed Feb. 14, 2007, the entirety of which is incorporated herein by reference in this application.

BACKGROUND OF THE INVENTION

1. Field of the Invention

The present invention relates to the field of the equestrian activities, particularly to a saddle and means for riding an equine and, more particularly the invention refers to means for adjusting a saddle in order that the same may be used in equines having different back sizes or in the same equine that, by any circumstance, the size of the back or withers thereof have increased or decreased, wherein a saddle according to the invention may be adjusted to any new size as well as parts thereof may be installed and removed in an easy and quick manner without the need of expertise.

2. Description of the Prior Art

It well known that a saddle, particularly those employed in equestrian activities are composed of a complex structure combining leather working and engineering to provide comfort and safety not only for the rider but also for the horse. A bad saddle will cause affliction to the horse and rider when no correct fit of the saddle is obtained in the back or withers of the horse generally due to an incorrect design or manufacture of the saddle. This discomfort leads to future affections of the horse and rider as well as to a handicap for any sport competition.

Any saddle generally has an upper part or surface designed for sitting the rider and a bottom part or surface open at an angle to accommodate to the back or withers of the animal. When a rider employ more than one horse, for example in several sportive competitions such as polo, the rider is provided with several saddles, generally one saddle per horse wherein each saddle is designed to fit the size of the animal where the saddle will be employed. Thus, each saddle has a design with a bottom part thereof having an opening forming an angle or predetermined angle that fits the size and anatomy of the horse's back.

In other situations, when only one horse is employed, it may happen that in short or long periods of time the anatomy of the horse had changed in an extent that the saddle usually employed for that horse becomes anatomically inappropriate. This is a frequent complication when the horse gets weight or looses weigh thus varying the angular profile of the back thereof, particularly the horse's withers. Since the saddle has been designed with a predetermined angle to fit the former horse's anatomy, the saddle will not yield its form to the anatomy changes and will not fit adequately.

Under the above circumstances many attempts have been made to design a saddle having a structure with the capacity of being adjusted in its dimensions, particularly in the angle of the bottom part of the saddle, to fit to the new characteristics of the animal anatomy. However, the solutions provided by the prior art have failed in that the same are complex, expensive, not reliable and they require of technical skillfulness and specialized workers to carry out the necessary adjustments.

Among the known solutions there are saddles having a structure or tree that is comprised of two or more hinged portions. These portions are hinged along a center line of the saddle, namely a line coinciding with the spine of the horse, and the parts can be angularly moved in order to open or close the parts relative to each other for altering the opening of the saddle to a desired angle according to the back shape of the horse. This regulating movement is achieved by means of a hinge and adjusting system that requires of strong, complex, bulky and heavy mechanisms including metal plates, bolts, levers and nuts. A system of this type is disclosed in GB 2254234 to the UK firm Thorowgood Limited.

U.S. Patent Application No. 2005/0120683, to Swain, discloses a saddle tree including a progressive flex headplate capable for properly fitting a variety of different size horses, wherein the headplate is constructed of a plurality of flexible, and resilient overlapping layers secured together at a top of the headplate with the layers increasing in length from top to bottom wherein the assembly provides progressive flexure to fit horses of varying widths. As mentioned above comfort and proper fitting mostly exclusively depends on the as exact as possible design of the structure and bottom part of the saddle to copy the back of the equine. The saddle of Swain has a fixed bottom shape, this is that the bottom is open at a fixed angle and it is expected that the headplate yields upon the weight of the rider to accommodate to the horse's back. However, the fixed angle could fit size within an average size of the horse's back but will not fit properly in other dimensions, for example thin backs or wide backs. In addition, the top of the headplate is mostly rigid therefore while the distal ends of the layers may yield and flex under the rider's weight if the angle of the top part is not the correct one this part will be floating over the withers and back without offering a correct fitting.

U.S. Patent Application No. 2005/0011167, to Belton, discloses a saddle tree including a front part comprising a bridging element with an internal surface for receiving an engagement part of a bearing part. Engagement part is configured to fit closely with receiving part and a plurality of different bearing parts can be provided, each of which having a generally similar engagement part but each differing insofar as the internal configuration, as it is indicated by reference 30 in FIG. 4. The internal configuration of each bearing member is designed to accommodate to the dimensions of the horse concerned. Thus the shape of the tree, and particularly the shape of the head plate or front part of the tree, is not modified to accommodate to the horse but only the internal configuration of the bearing part is designed to different dimensions, in other words, each different bearing part has different thicknesses which causes the head plate of the tree to have different thicknesses. This may cause a concentration of stress in the horse because the weight of the rider is not distributed uniformly all along the pads of the saddle but an important part of the weight is concentrated onto the horse through the thicker portions of the bearing part.

All the above known systems have not entered into a known market perhaps because the costs and complexities thereof have caused them to be no competitive. In addition, because of their complexity they require of special maintenance to guarantee that, when needed, it operates as expected and, if not well maintained, when one needs to use them it does not work properly. Even in addition there is one aspect that is of very much importance in any saddle but particularly in a saddle of high costs such as the saddles for competition and this aspect is the appearance and aesthetic of the saddle. The above regulation system makes difficult, if not impossible, to design and manufacture a high quality saddle with fine and delicate terminations and fittings.

Under the above circumstances it would be very convenient to have a new adjusting system and or adjustable saddle capable of being adjusted to fit varying horse sizes with no need of expertise or specialized personnel, and in an easy and quick manner, and also permitting to manufacture a saddle without alterations as to the design is concerned.

SUMMARY OF THE INVENTION

It is therefore an object of the invention to provide a new saddle provided with adjusting means for quickly and easily adjusting the saddle to fit several horse sizes without the need of skilled personnel, with the aid of only simple tools such as a screwdriver and with an easy access to the adjusting means, without the need of disassembling the saddle to adjust the saddle.

It is still another object of the present invention to provide an adjustable equestrian saddle and adjusting and reinforcing system for adjusting an equestrian saddle to permit the saddle fit several sizes of the back and withers of one or more horses, wherein the adjusting system comprises a plurality of reinforcing members having different angular dimensions with the saddle having a tree comprising a flexible front part or headplate for interchangeably receiving the reinforcing members in a manner that the tree and head plate are deformed to accommodate each different reinforcing member.

It is a further object of the present invention to provide an adjustable saddle for equestrian use, of the type having a tree with a seat, a resilient headplate, a cover for providing comfort and cushion for the rider and elongated pad members forming a cushion between the saddle and a back of the equine, wherein the head plate includes a rigid reinforcing member removably connected to the head plate by fixation means having at least one portion thereof accessible from outside the saddle and wherein the rigid reinforcing member is preferably one of a reinforcing assembly comprising a plurality of interchangeable rigid reinforcing members, wherein each rigid reinforcing member has an inverted V-shape to accommodate to the back of the equine and the V-shape is open at different predetermined angles with each predetermined angle corresponding to one of said rigid reinforcing member.

It is a further object of the present invention to provide a reinforcing assembly for use in an equine saddle for adjusting the saddle to different sizes of horse backs, the reinforcing assembly comprising a plurality of reinforcing rigid members for interchangeably attaching to the saddle, wherein each reinforcing rigid member has an inverted V-shape with the V-shape being open at different angles for each reinforcing rigid member in order to accommodate to different back sizes of the equine.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Now referring in detail to the invention, the same refers to a saddle generally indicated by numeral reference 1 that comprises an inner frame or tree 2 and a plurality of covering materials to provide comfort and cushion not only for the rider but also for the horse. Saddle 1 may be flocked with any appropriate material such as polymeric foams, wool, synthetic or natural fibers, air and any material according to the use and quality of the saddle. These covers are extended and arranged all around the inner structure forming pads, skirts, flaps, panels and the like all indicated by reference 3 in phantom lines to show transparency. Generally, the leather parts and pads are conventional ones except when the opposite is indicated and when some of them, such as elongated pads "B" in FIG. 6, incorporate the teachings of the invention which is mostly incorporated in the inner structure or tree.

Figure 1:
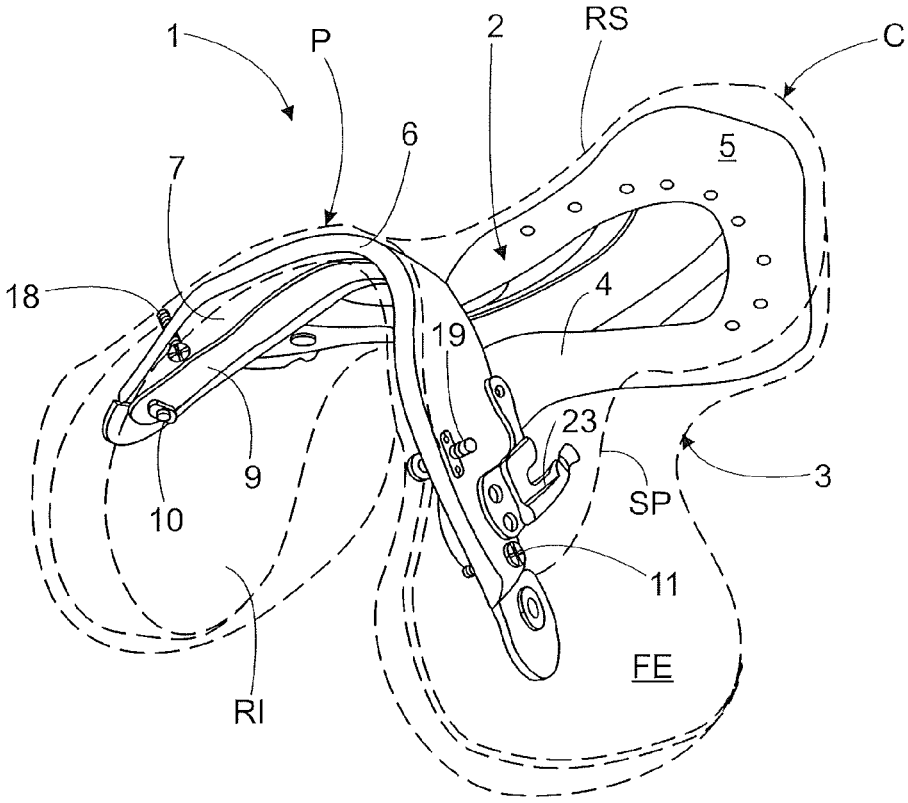
FIG. 1 shows a perspective view of a saddle according to an embodiment of the invention wherein the tree or inner frame is illustrated in solid lines while the outer cover materials, such as the leather, cushion pads, skirt panels, etc. are shown in phantom lines.
Figure 2:
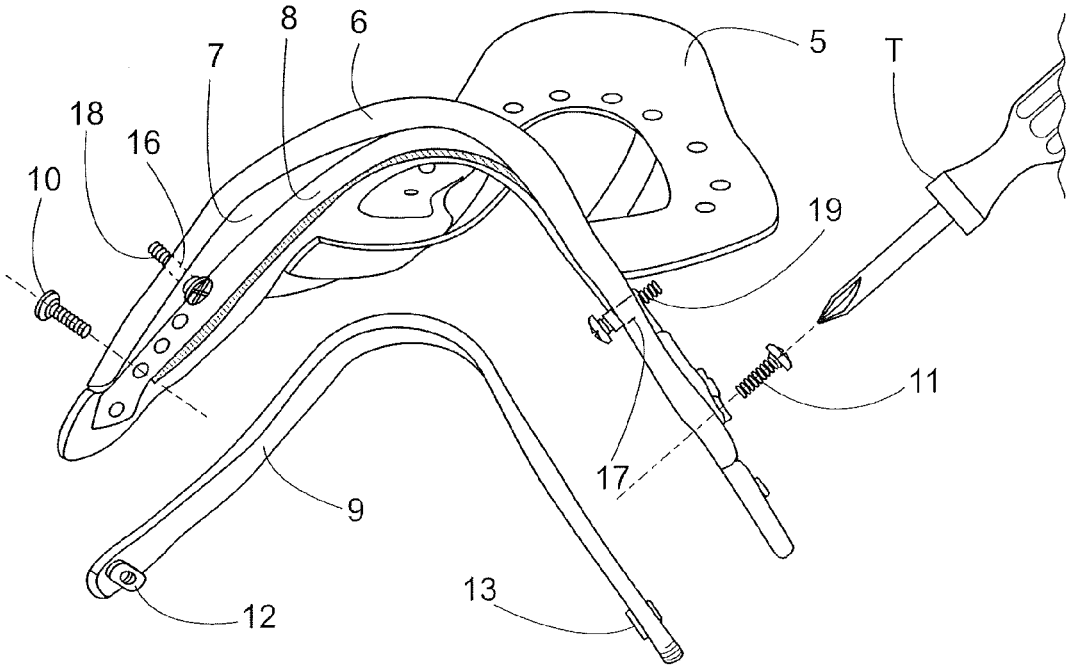
FIG. 2 shows an exploded perspective view of the tree of the saddle of FIG. 1, shown from a front part of the saddle and slightly from the bottom thereof.
Figure 3:
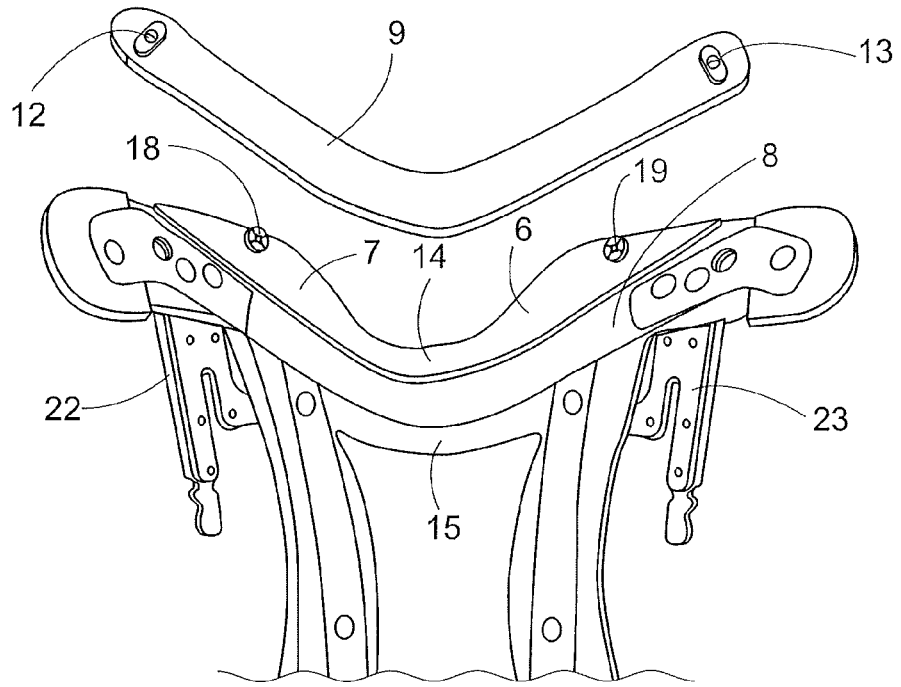
FIG. 3 shows an exploded plant bottom view of the tree of the saddle of FIG. 1.
Figure 4:
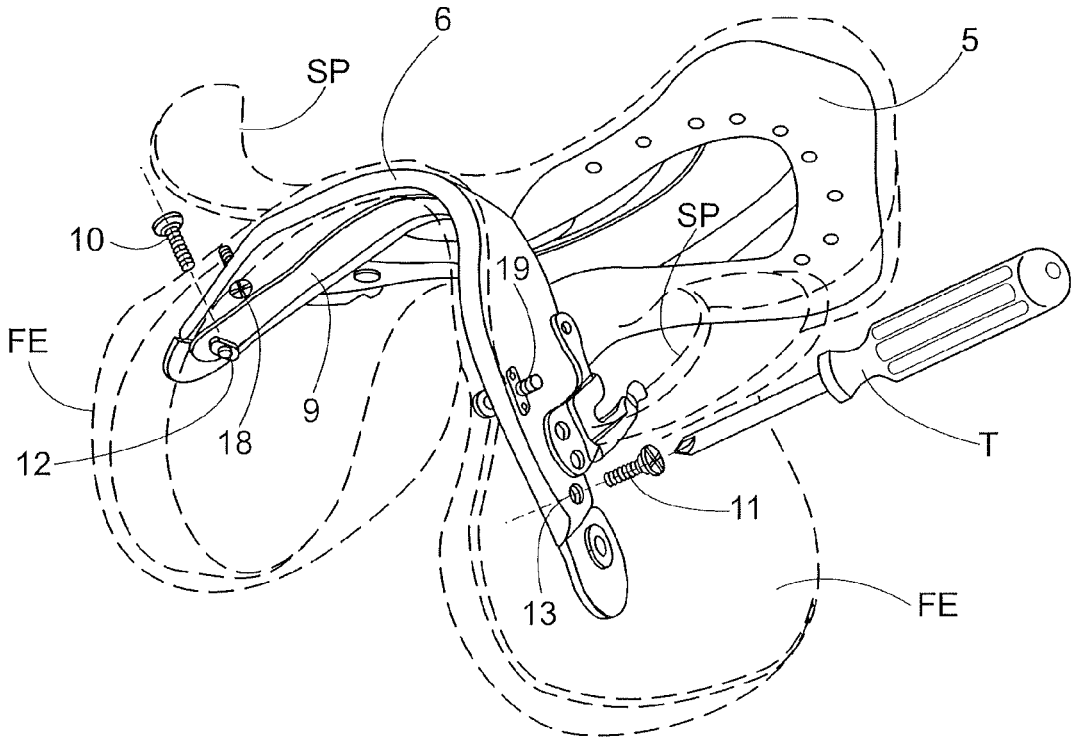
FIG. 4 shows a perspective view of the inventive saddle, similar to FIG. 1, but illustrating a tool acceding to the fasteners means of the invention from outside the saddle, either through the bottom or the side parts of the saddle.
Figure 5:
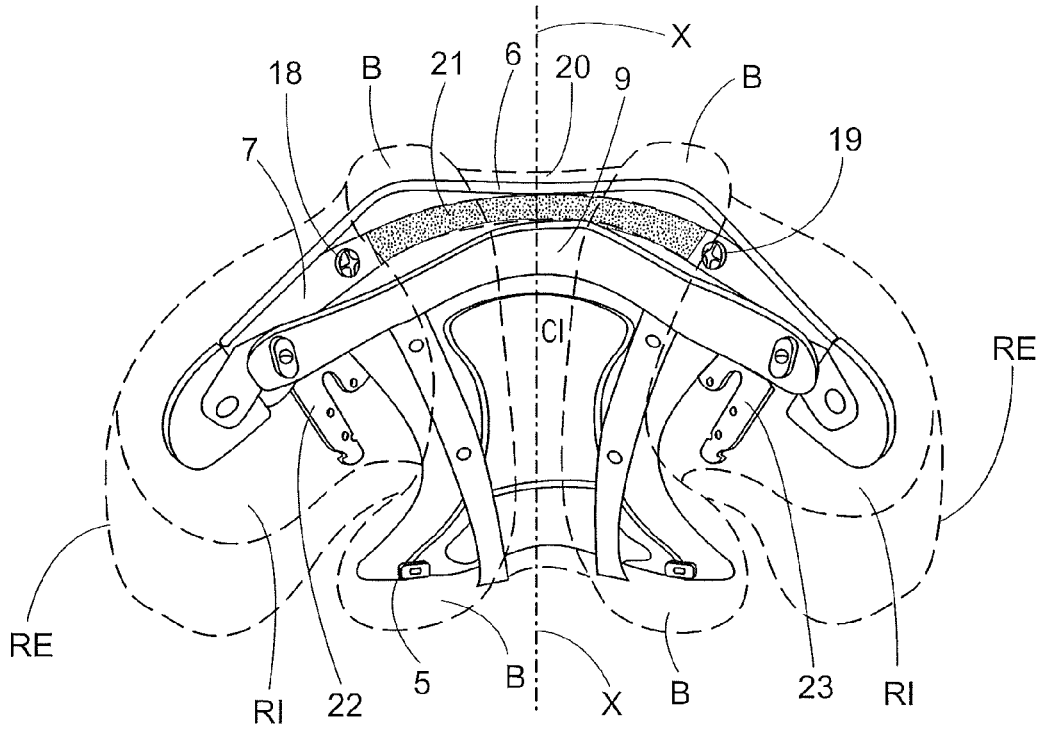
FIG. 5 shows a bottom and front perspective view of the saddle of FIG. 1 with a rigid reinforcing member secured to the headplate, with the tree, the headplate and rigid member illustrated in solid lines and the cover materials and other parts of the saddle shown in transparency.

According to FIG. 1 the saddle may have an upper cover or liner RS forming the surfaces of a seat for the rider, and outer skirts "FE". In like manner, the lower or bottom part of the saddle includes bottom skirts or covers "RI" each one including at least one elongated pad member "B" arranged at each side of a center line X-X, FIGS. 5, 6, and partially covering a central web portion "CI", to form a cushion between the saddle and the back of the horse at each side of the horse's spine.

Tree 2 may be constructed conventionally of any material such as wood, plastics, resins, light metals, etc. reliable to incorporate the teachings of the invention. Tree 2 has a middle part 4, a rear part 5 and a front part forming a flexible headplate 6 having a general inverted V-shape having a bottom or lower surface or face 7 designed to rest onto the back or withers of the horse and that, according to the invention, is provided with an elongated recess or channel 8 for receiving and securing a rigid reinforcing member 9 that is removably connected to the head plate by fixation means having at least one portion thereof accessible from outside the saddle and to which means reference will be made below. Member 9 is preferably a metal band having a thickness corresponding to the depth of recess 8 and more preferably band 9 remains entirely within the recess in order that bottom face 7 is uniform and if band 8 must be thicker the thickness will not affect the horse.

Also according to the invention, rigid member 9 is part of an inventive reinforcing assembly comprising a plurality of interchangeable rigid reinforcing members, wherein each rigid reinforcing member has an inverted V-shape to accommodate to the bottom surface and recess 8 and to the back of the equine. Each V-shaped member 9 is open at a predetermined angle and the predetermined angles of all the rigid members of the assembly will be different from each other in a manner that each predetermined angle, corresponding to each one of said rigid reinforcing member, will accommodate to or fit a size or dimensions of different horses or to the changing dimensions of a horse that, for example, gains or looses weight.

For instance, a saddle is manufactured and has a reinforcing member having an angle designed for a given horse. If the horse gains weight along the time, the saddle will not fit the new dimensions of the horse and, if a conventional saddle, the reinforcing member conventionally welded or riveted to tree 2, and with the leather liners and pads, adhered, glued or sewed entirely closing the inner structure, must be brought to a leather worker to disassembly at least the front part of the saddle to remove welding, rivets, an the like to replace the reinforcing member by a new one having an angle wider than the first member. Since this work requires of the use of heat to remove welding, or strong impacts to remove rivets the saddle must be opened in a large proportion to prevent damages in the leather liners, however, always the leather is at least minimally damaged.

According to the invention, member 9 is easily and quickly removed and replaced by another wider one, as will be described below, without disassembling the saddle. For this purpose, band 9 is secured into recess 8 by at least one fastener accessible from outside the saddle. More particularly, two screws 10, 11 are provided that are received in threaded orifices 12, 13 in band 9 and pass through the headplate and the outer lining materials "RS" in a manner that screws 10, 11 not only secures band 9 but also retains the upper and side liners in a zone above the outer skirts "FE" and below side skirts or skirt panels "SP". Therefore, while screws 10, 11 have their threaded stems retained in the structure and their heads easily accessible from outside the saddle, the screw heads do not appear visible but are hidden under the foldable skirts "SP".

At both sides of recess 8 two side resistant and flexible rims or strips 14, 15, are provided for compensating any decrease in the structural resistance due to recess 8 and for providing flexibility to accommodate to wider or closer rigid members 9. The angular opening of flexible headplate 6 will correspond to a design angle with capability to open or to close according to the rigid member installed into recess 8. This is important as long as the tree should accompany, as close as possible, the variations in the angles when forced by the interchanging rigid members 9 having different angles. Headplate has a strength enough to resist the stresses to which the saddle is subject to but it is flexible enough to be deformed and accommodate the angle of member 9.

Headplate 6 also includes at least two orifices 16, 17 at one side of recess 8 for threadably receiving screws 18, 19 for retaining, at this corresponding portion of the saddle, lower liners "RI" or any pad member to the tree. In addition, strip "CI" running along the center line of the saddle, has a front end portion 20 for fixing, by fixing means 21, to front edges of headplate 6 for providing termination to the assembly. Considering that all the bottom front assembly, including pad members "B", is already fixed or retained by screws 18, 19, there is no need of further fixation means or fasteners. For providing a better finishing, end portion 20 may be attached to the tree by a very well known fastener of hooks and loops 21 that can be manually closed and opened easily.

The assembly also includes other components and fittings such as a connector 22, 23 for girth tabs, not shown, at opposite sides of the saddle. According to the invention, these connectors are provided in a side upper surface of the headplate in order to prevent interference with the installation and/or removal of rigid members 9 into recess 8.

Distinctly from the saddles of the prior art, that reference to the structures thereof have been made above, a saddle according to the invention provides the aids to adjust the saddle to different horse sizes easily, quickly and without the need of skilled personnel to disassemble the saddle. In the event that the horse wherein the saddle is used gains weight and, hence the angle of the back is enlarged, the saddle must be adjusted, or opened, to fit the new dimensions. Thus, by lifting skirt panels "SP" access is provided directly to screws 10, 11 while access to screws 18, 19 is obtained by pulling portion 20 and dislodging the same from means 21, and spacing portion 20 and bottom cover "RI" slightly out from the tree. By unscrewing screws 10, 11, by means of a screwdriver "T" for example, rigid member 9 may be removed once portion 20 and cover "RI" are slightly spaced apart from the tree. A new rigid member can be then secured into recess 8 and fastened by screws 10, 11 and portion 20 and cover "RI" may be placed back into place and secured by screws 18, 19 and closing means 21.

While the screws have been shown with a cross-type notch, any screw or fastener may be used as long as the same may be easily removed by a simple tool such as screwdriver.

Figure 6:
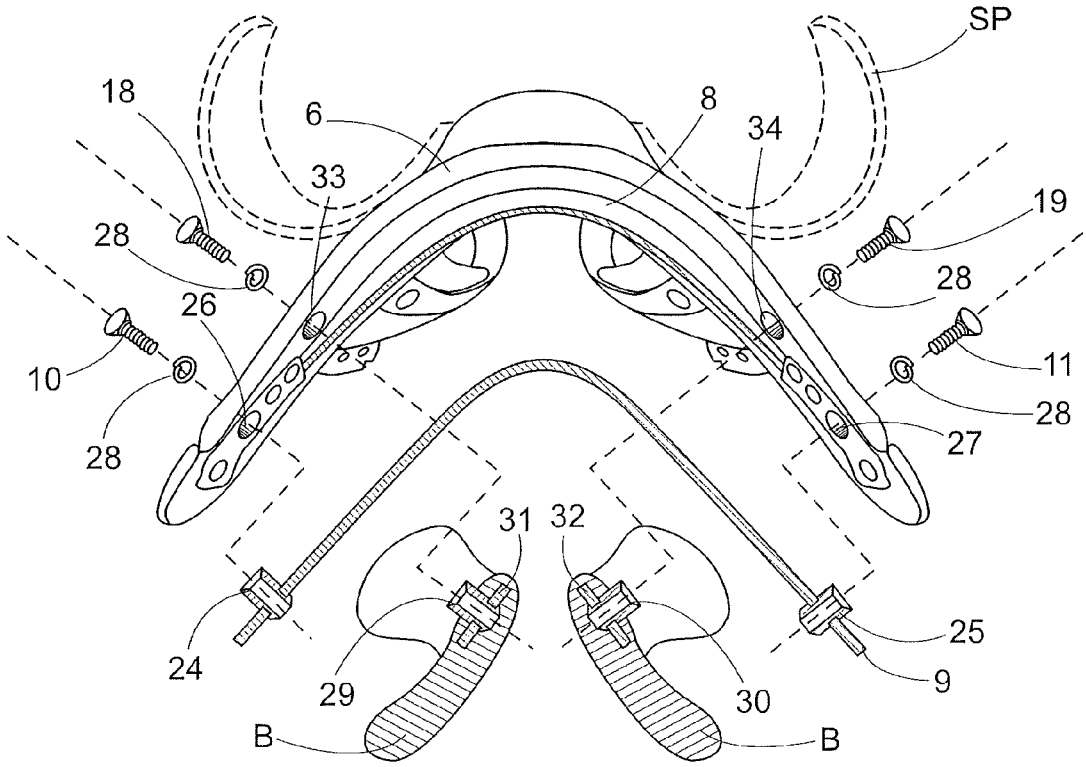
FIG. 6 is a partial cross-sectional front view of a saddle according to another embodiment of the invention with skirt panels, at opposite sides of the saddle, shown in phantom lines and folded to have easy access to the fasteners.
Figure 7:
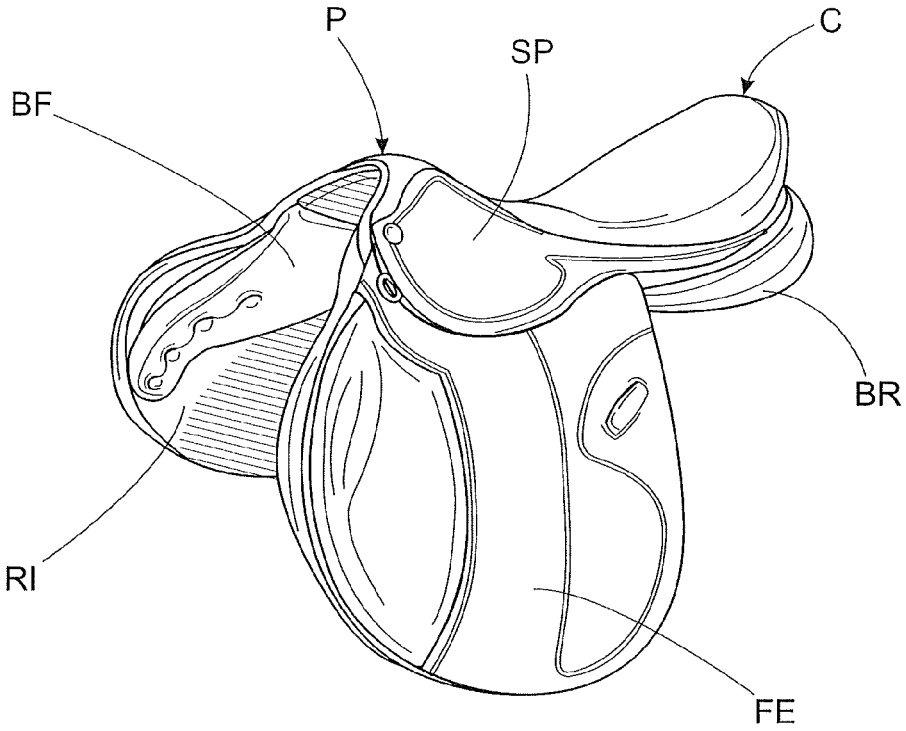
FIG. 7 is an upper front perspective view of a saddle according to the invention.

According to another embodiment of the invention, depicted in FIG. 6, threaded orifices 12, 13 of the first embodiment, are replaced or embodied by connecting threaded sleeves 24, 25 which are riveted, welded, or fixed by any other way, in rigid member 9. Each sleeve may have orifices passing entirely through the sleeve or the orifice may be a blind orifice. Each sleeve 24, 25 is preferably designed to enter into orifices 26, 27 in band 9. Thus, when the rigid member must be installed into the saddle the member is placed into recess 8, with connecting sleeves placed into orifices 26, 27, and screws 10, 11 are introduced and screwed into sleeves 24, 25 to secure rigid reinforcing member 9 in position. Heads of screws 10, 11 are easily acceded form outside the saddle, particularly from the opposite sides thereof once skirts "SP" are lifted to have access to the screws. The firm and permanent connection of screws 10, 11 into sleeves 24, 25 may be guaranteed by any kind of resilient washers 28. Other blocking or gripping means may be provided to prevent the screws to get loose.

At the bottom part of the saddle elongated pad members "B" are arranged to provide cushion between the saddle and the horse. When rigid members 9 must be removed and replaced by another interchanging rigid member, said pad members does not need to be entirely removed but only detached at a front part of the saddle and lifted the end of the pad member to have access to the headplate as shown in FIGS. 9-12 in connection to a further embodiment. This is made by unscrewing screws 18, 19 that, distinctly from the embodiment of FIGS. 1-5, are acceded from the outer or upper side of the saddle, also under skirts "SP", that causes any replacement of the rigid members is still easier than the one of the other embodiment. Pads "B" include connecting threaded sleeves 29, 30 which may be like sleeves 24, 25 and are embedded into the body of the pads. To be retained properly into the body of pads "B" each sleeve 29, 30 is joined to a plate 31, 32 which may be placed into the body of the pad "B" during the manufacture of the pad. Sleeves 29, 30 are designed to pass through orifices 33, 34 in the headplate and receive screws 18, 19 which also may use of elastic washers 28.

Pads "B" are designed according to conventional techniques and may be made, for example, of urethane polymer foam or natural or synthetic wool, like other components of the saddle, and therefore plates 31, 32 will be designed to guarantee a good retention into the foam or wool. Said plates 31, 32 may be fixed to sleeves 28, 29 or may be made of only one piece together with the sleeves. The design of the plates will also accommodate to any design of the pads, namely the dimensions and the geometry of pads "B".

Connecting sleeves 24, 25, 28, 29 may be made of any appropriate and light material, such a light metal, and they may be entirely interiorly threaded and the opening thereof for receiving the screws may be provided with a biased edge, as illustrated in FIG. 6, in order to facilitate the introduction of the stem of the screws into the sleeves.

According to still another embodiment of the invention, the saddle of the invention, the bottom view of which is depicted in FIGS. 8-12, is comprised of outer skirts "FE", bottom skirts or covers "RI" and pad members "B" one at each side of center line X-X of the saddle. Pads "B" are generally affixed to bottom skirts "RI" and all together are affixed to the saddle body or inner tree 2, see FIG. 1. Pads "B" and skirts "RI" does not extend over a central portion "CI" of the saddle which central portion remains uncovered by the skirts and pads. This portion "CI" is part of the saddle body and is covered by the general liner, preferably leather, of the saddle.

The saddle of FIGS. 7-12 includes the same features of the invention that are present in the embodiments of FIGS. 1-5 and/or FIG. 6. To facilitate the description of this embodiment reference is also made to two end portions of the saddle, namely the cantle "C" that houses rear part 5 of the tree, and pommel "P" wherein head plate 6 is included. The ends of pads "B" at the region of cantle "C" are rear ends "BR" and the ends of pads "B" at the region of pommel "P" are front ends "BF". In this embodiment, detachable and/or removable lid or cover means, generally indicated by reference 35, are provided in the bottom side of pommel "P" to have easy and quick access to the adjustable system of the invention, in order to replace the interchangeable inverted V-shaped bearing members.

Cover or lid means 35, as better shown in FIGS. 9-12, comprise a lid 36 that is affixed, at one edge thereof, to a front edge of the saddle, in the pommel region, and is formed of any suitable flexible material, preferably the same material employed as a liner in the saddle, most preferably leather. Lid 36 looks as a continuation of central region "CI", therefore, the liner at central region "CI" and lid 36 are made of the same material. Lid 36 has a free edge 37, see FIGS. 9, 11, that is detachably connected to region "CI" by retention means 38, 39 provided in the lid and the central region, respectively. Means 38 may be at least one orifice or buttonhole and means 39 may be at least one pin, or button or the like. Alternatively, retention means 38, 39 may be a press stud, a resilient clip, or any other type of fastener.

Figure 9:
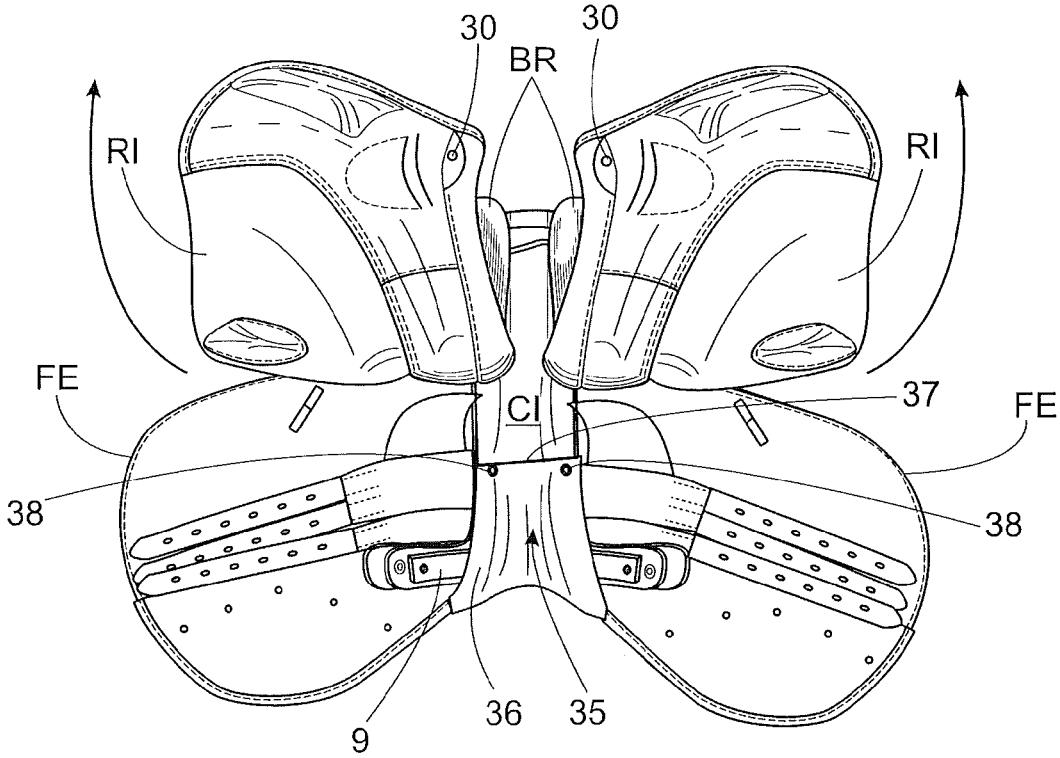
FIG. 9 is a plan view of the saddle of FIG. 8 with the front ends of the two bottom skirts or covers, including the panels or padding, being disengaged and lifted from the saddle and with a cover or lid means covering the reinforcing member of the inventive adjusting system.

As it was already disclosed, pad "B" is affixed to bottom skirt "RI" and both are affixed to head plate 6 and bearing or reinforcing member 9 through screws 18, 19 that are received in threaded sleeves 29, 30, see FIGS. 6, 9-12. Screws 10, 11 also retain member 9 by being received in threaded sleeves 24, 25 of the reinforcing member. In order to detach front ends "BF" of pads "B" and cover "RI", panels "SP", see FIGS. 6, 7, must be lifted to have access to the heads of screws 18, 19, and 10, 11, at each side of the saddle. Once these screws are unscrewed and removed, front ends "BF" of pads "B" and skirts "RI" may be manually lifted as shown by the curved arrows in FIG. 9 in order to clear the way to lid means 35. FIG. 9 shows lid 36 in a closed position, covering, at least partially, the reinforcing member of the adjusting system of the invention. In this closed position, retention means 38, 39 are connected to each other.

Figure 10:
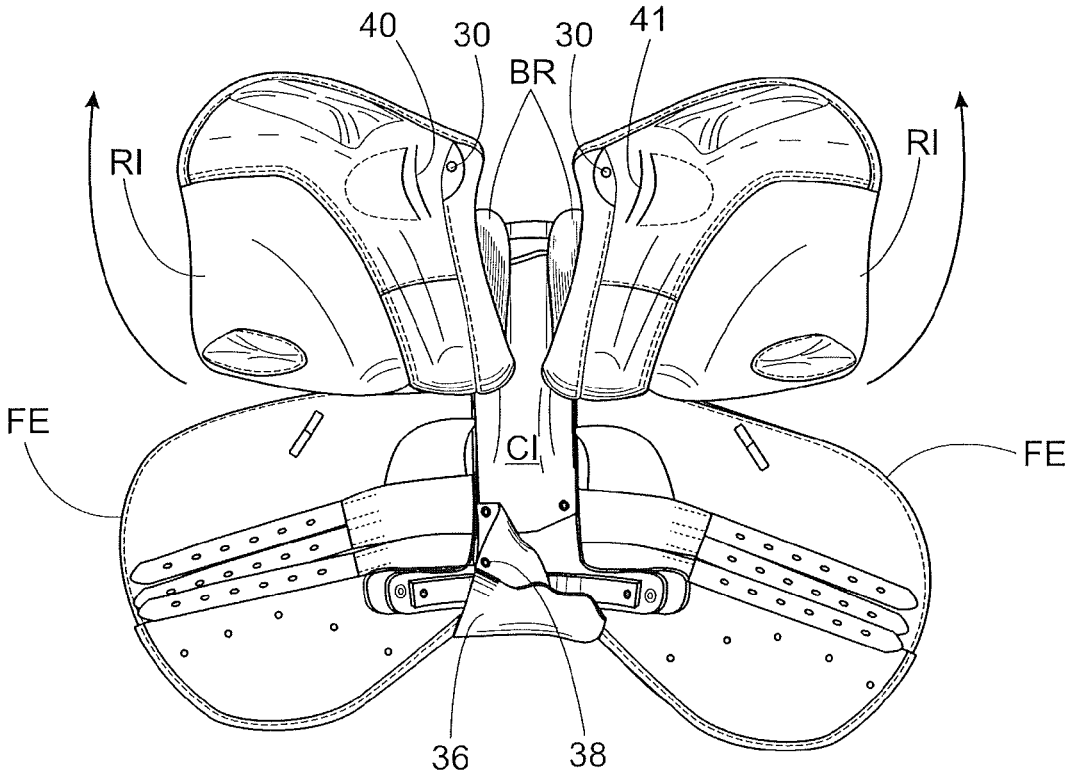
FIGS. 10-12 are plan views of the saddle of FIGS. 7-9 with the bottom skirts and pads lifted and with the cover or lid means disengaged and lifted to gain access to the reinforcing member which is shown as being removed.
Figure 11:
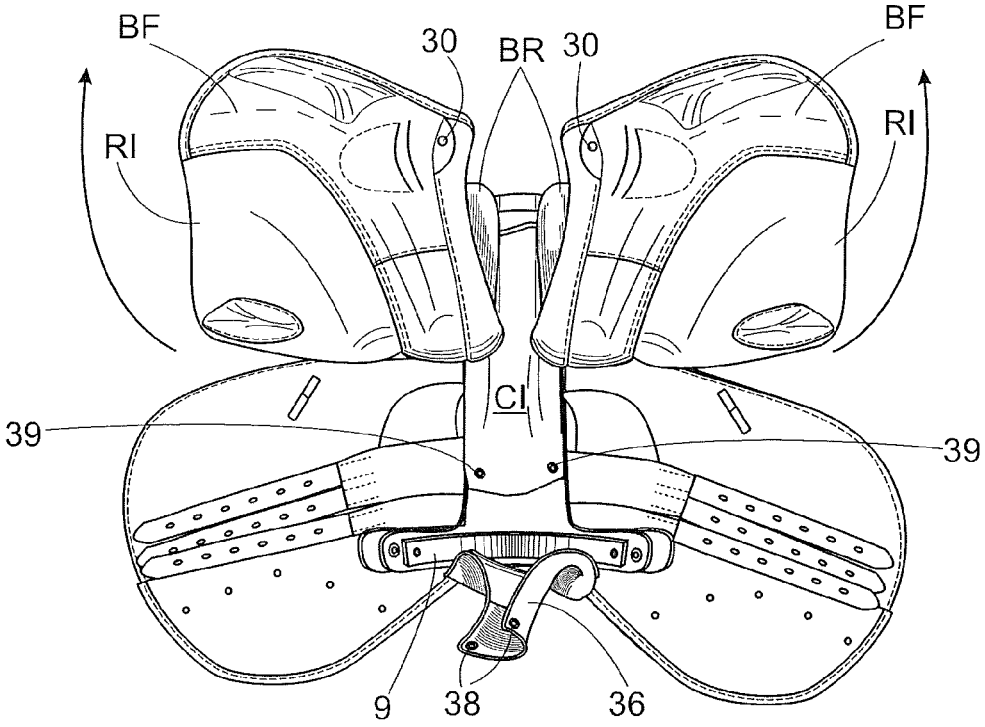
Figure 12:
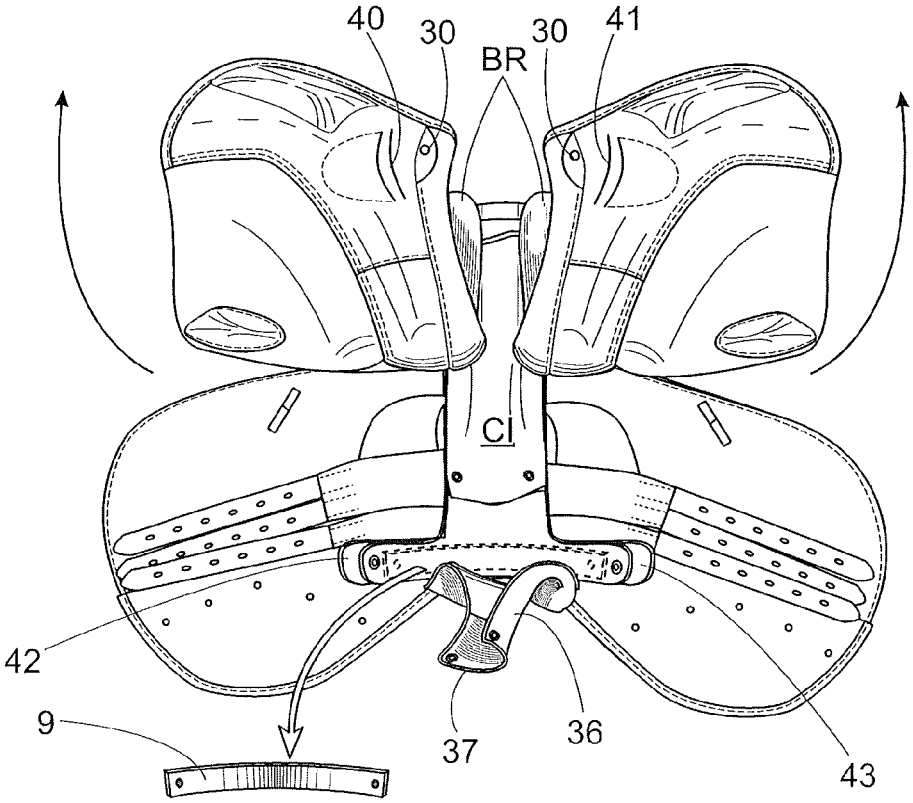

To gain access to member 9 the retention means must be detached and lid 36 lifted as shown in FIGS. 10-12. Once entirely lifted, as shown in FIGS. 11, 12, reinforcing member 9 may be manually and easily removed, as indicated by the arrow in FIG. 12, and a new member 9, having a different angular shape, may be inserted in recess 8 of head plate 6. Once the new member is inserted, lid 36 is closed to the position shown in FIG. 9, by attaching means 38, 39 to each other. The new inserted reinforcing member, having a different angular shape, will not change the general configuration of the saddle but only will deform the head plate and tree which is made of a resilient or flexible material. Thus, the saddle will be easily opened or closed to fit the new dimensions of the horse or the dimensions of a new horse.

Figure 8:
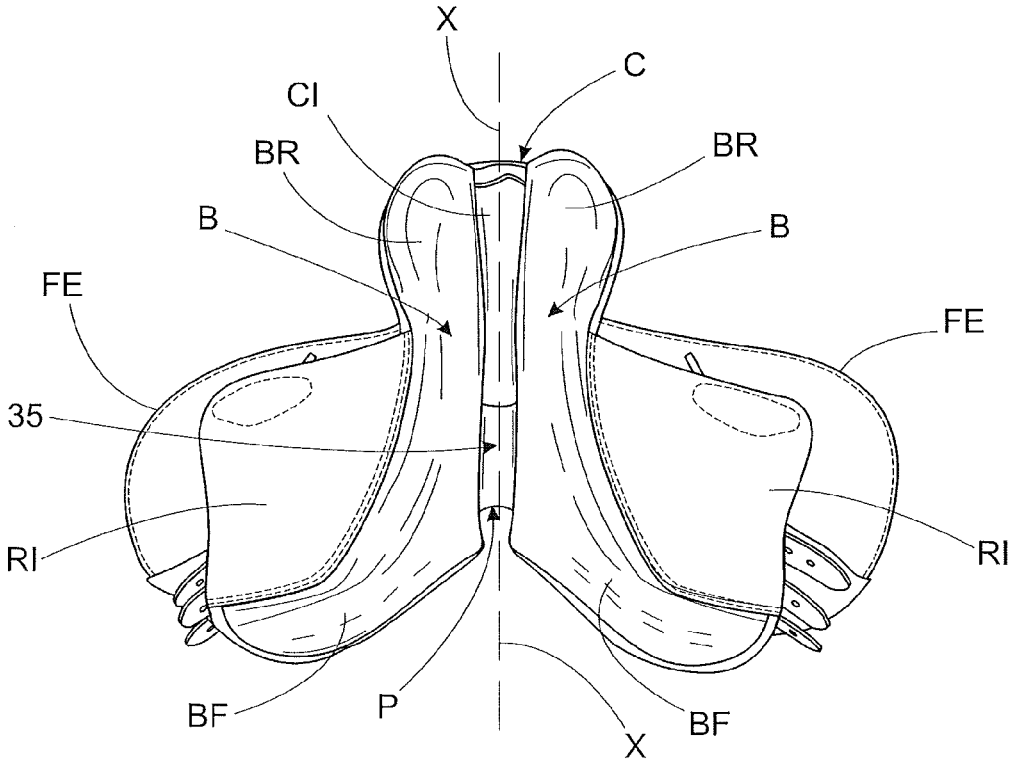
FIG. 8 is plan view of the saddle according to the invention wherein the saddle is viewed from the bottom side or horse-facing side, namely the side of the saddle that faces the horse's back.

The assembly formed by bottom skirts "RI" and pads "B" includes, at bottom surfaces thereof, respective pockets 40, 41 the purpose of which is to receive ends 42, 43, respectively, of the head plate or any support that the head plate may include to provide additional strength. Once the new member is inserted and lid 36 closed, as describe above, skirts "RI" and pads "B" are moved back to their original positions, as shown in FIG. 8, inserting ends 42, 43 into pockets 40, 41. Screws 10, 11, 18, 19 are inserted in sleeves 24, 25, 29, 30 as shown in FIG. 6 and all the components are connected to each other again.

While preferred embodiments of the present invention have been illustrated and described, it will be obvious to those skilled in the art that various changes and modifications may be made therein without departing from the scope of the invention as defined in the appended claims.

The invention claimed is:

1. An adjustable saddle for equestrian use, wherein the saddle comprises a tree with a seat, a cover for providing comfort and cushion for the rider and elongated pad members forming a cushion between the saddle and a back of the equine;

a flexible headplate in the tree, wherein the headplate comprises a V-shaped rigid reinforcing member of a plurality of inverted V-shaped rigid reinforcing members each having the same uniform thickness but different angular V-shapes, wherein one inverted V-shaped rigid reinforcing member having one angular V-shape may be removed and replaced by another one inverted V-shaped rigid reinforcing member having a different angular V-shape, with the headplate having a flexibility capable of permitting the headplate to resiliently deform and accommodate to any one of the rigid reinforcing members, the one rigid reinforcing member being removably connected to the head plate by removable fixation means, and wherein a bottom face of the headplate includes an elongated recess for receiving said rigid reinforcing member, wherein said elongated recess for receiving said rigid reinforcing member has a depth so that the reinforcing member fits within the elongated recess without changing the thickness of the head plate, whereby the angular configuration of the headplate is modified by affixing a different reinforcing member, with the thickness of the saddle being the same for any one of the plurality of reinforcing members affixed to the head plate;

lid at a bottom side of the saddle, the lid having at least one free edge detachably connected to the bottom side of the saddle in order to define a closed position wherein the reinforcing member is at least partially covered by the lid and an open position providing access to remove the one reinforcing member and replace it by another reinforcing member without disassembling the saddle.

2. The saddle of claim 1, wherein the lid extends along part of a central region between the pad members and partially covered by the pad members.

3. The saddle of claim 2, wherein the lid is a piece of a flexible liner material that is connected, at one edge thereof, to a front edge of the saddle, in a pommel region of the saddle, and the at least one free edge of the lid is opposite to the one edge connected to the front edge of the saddle.

4. The saddle of claim 2, wherein the at least one free edge of the lid are detachably connected to a bottom side of the saddle by manually detachable retention means.

5. The saddle of claim 4, wherein the detachable retention means comprises at least one buttonhole in the lid and at least one button in the central region of the bottom side of the saddle.

6. The saddle of claim 4, wherein the detachable retention means comprises at least one resilient clip.

7. The saddle of claim 2, wherein the pad members comprise one pad member at each side of a central region and each pad member is affixed to a bottom skirt, and a pocket is included in at least one of the pad member and the bottom skirt, at each side of the central region, to receive respective ends of the head plate.

8. The saddle of claim 1, wherein the fixation means has at least one portion thereof remaining outside the cover but hidden below a part of the cover that can be lifted up to gain access to such portion of the fixation means.

9. The saddle of claim 1, wherein each rigid reinforcing member comprises a metal band.

10. The saddle of claim 1, wherein said fixation means comprises screws removably retaining and passing through at least the cover, the headplate and the rigid reinforcing member, with at least one screw at each opposite side of the saddle, each screw having a screw head accessible at an outer surface of the cover.

11. The saddle of claim 10, wherein each screw head is accessible at said outer surface of the cover, and hidden under a folding skirt panel.

12. The saddle of claim 11, wherein said rigid reinforcing member has at least two orifices, one at each opposite side thereof, each orifice for receiving one of said screws.

13. The saddle of claim 12, wherein said screws comprise four screws, with two screws at each opposite side of the saddle and wherein said elongated pad members comprise two elongated pad members, one at each side of a center line of the saddle and at a bottom side of the saddle, each pad member having an embedded connecting threaded sleeve for receiving one of said screws.

14. The saddle of claim 12, wherein each orifice of the rigid reinforcing member includes a connecting threaded sleeve for receiving one of the screws.

* * * * *